United States Patent [19]

Marfatia et al.

[11] 4,082,077

[45] Apr. 4, 1978

[54] OVEN DOOR LATCH

[75] Inventors: Anil C. Marfatia, Brooklyn Center; George A. Jarvis, Minneapolis, both of Minn.

[73] Assignee: Litton Systems, Inc., Beverly Hills, Calif.

[21] Appl. No.: 707,863

[22] Filed: Jul. 22, 1976

[51] Int. Cl.[2] ..... F23M 7/00

[52] U.S. Cl. ..... 126/197; 292/120; 292/218

[58] Field of Search ..... 126/191, 197; 292/92, 292/117, 120, 128, 213, 218, 228

[56] References Cited

U.S. PATENT DOCUMENTS

| | | | |
|---|---|---|---|
| 2,741,505 | 4/1956 | Courney | 292/128 |
| 3,099,471 | 7/1963 | Scott et al. | 126/197 |
| 3,831,580 | 8/1974 | McLean | 126/197 |
| 4,013,312 | 3/1977 | DeWeese | 126/197 |

*Primary Examiner*—John J. Camby
*Assistant Examiner*—Larry I. Schwartz
*Attorney, Agent, or Firm*—Robert E. Lowe

[57] ABSTRACT

A door latch mechanism for a domestic cooking appliance of the type wherein conventional thermal energy cooking and microwave energy cooking can be carried out in a single oven cavity, the mechanism including a rotatable oven door handle having a latch catch and door locating guide operably connected to it, a locking roller fixed within the oven cabinet for engaging the latch catch when the door handle is rotated to lock the door in the closed position for a microwave cooking or pyrolytic self-cleaning sequence of operation.

7 Claims, 3 Drawing Figures

FIG. 1
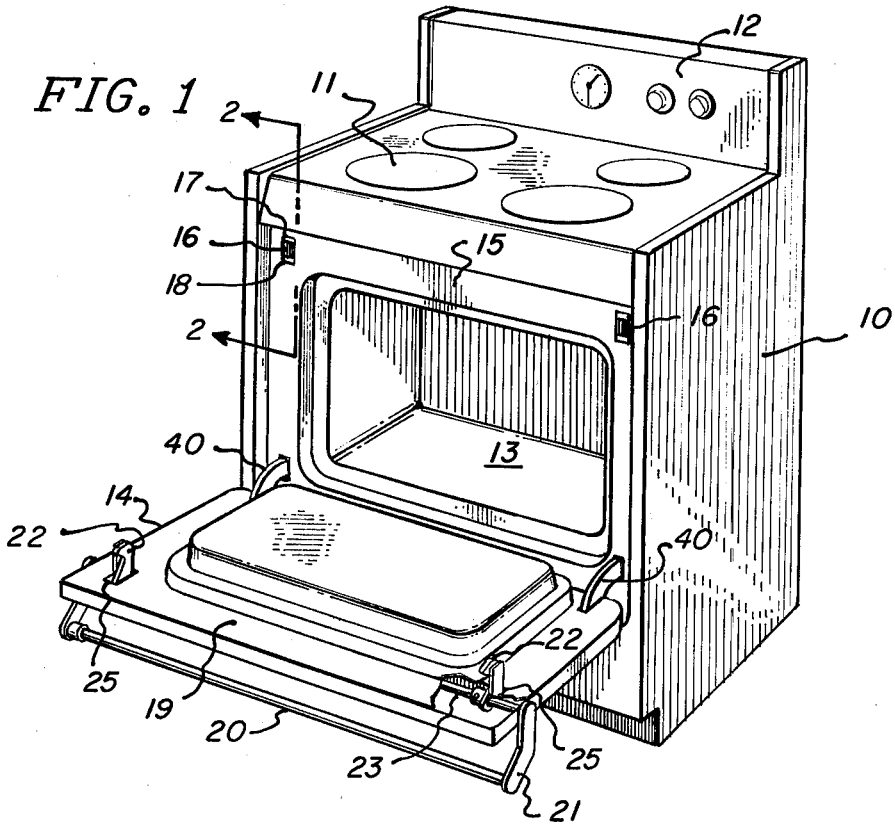
FIG. 3
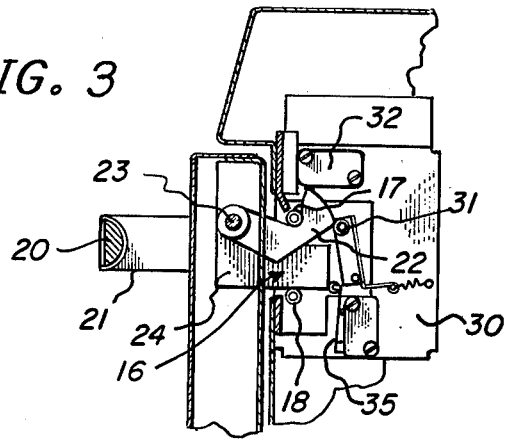
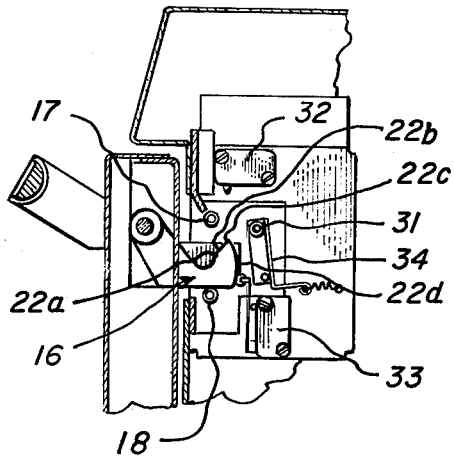
FIG. 2

OVEN DOOR LATCH

BACKGROUND OF THE INVENTION

This invention relates to the field of domestic cooking appliances, and more specifically to the field of cooking appliances of the type adapted to preform cooking through the use of conventional thermal energy means as well as through the use of microwave energy means, and even more specifically to those cooking appliances adapted to perform both types of cooking within a single over cavity. As used in this application, the term "combination cooking" refers to the process of cooking foods by means of conventional thermal heating and microwave energy simultaneously, and an appliance adapted to carry out combination cooking shall be referred to as a "combination oven".

In recent years, electronic or microwave ovens have become an increasingly popular domestic cooking appliance. Such ovens have gained their popularity largely because of the speed at which cooking can be accomplished, as well as the relatively efficient energy usage of such ovens.

It is also recognized that certain kinds of cooking and foods can be prepared in a more aesthetically pleasing fashion in a conventional oven using thermal energy rather than cooking the food with microwave energy. Thus it is sometimes preferred to carry out the baking of some pastry items or the browning of other foods in a conventional manner.

Recent developments have produced domestic cooking appliances wherein both types of cooking can be carried out in a single cavity, and the present invention is directed toward such an appliance. There are several problems that must be overcome in order to manufacture such an appliance at a reasonable cost, and to produce such a product that is aesthetically pleasing and attractive in the modern kitchen. Because such an oven is designed to carry out microwave cooking as well as conventional cooking, the oven door must be capable of being secured in such a fashion as to meet the applicable government regulations for microwave energy apparatus. Moreover, since conventional cooking is to be carried on in the oven cavity as well, it is most desirable to provide for the oven cavity to be pyrolytically self-cleaning, again requiring a latch mechanism capable of safely sealing and locking the oven during such operation.

Door latch systems of the type commonly employed on microwave ovens alone are not generally adaptable to use with a free standing range type of appliance. Previous attempts to add a microwave cooking capability to free standing ranges has resulted in the addition of an extra operating latch which must be engaged prior to conducting microwave cooking.

SUMMARY OF THE INVENTION

It is therefore an object of the present invention to provide an oven door latch system especially adapted for use with a combination range whereby the oven door can be effectively locked during microwave cooking or pyrolytic self-cleaning operations.

A further object of the present invention is to provide an over door latch mechanism which allows the oven door to be locked through the use of a single handle and does not require the user to operate any separate locking levers.

A still further object of the present invention is to provide means whereby a combination range door can be locked for microwave cooking or pyrolytic self-cleaning and wherein a signal indicating such locked condition can all be accomplished with a single operation of the oven door handle.

Further objects and advantages of the present invention will become apparent as the specification proceeds.

The present invention provides an oven door latch system for a combination range in which both microwave cooking and conventional cooking are conducted in a single cavity. The latch system is operated by the oven door handle which extends substantially across the width of the oven door. A latch catch is operably connected to the oven door handle mechanism to be moved in conjunction with the movements of said handle, and specifically is designed to be moved in rotational motion as the handle is rotated, both about a common axis of rotation. The oven body portion includes a locking roller mounted in a strike assembly for engaging the latch catch as the catch is rotated and holding it and the oven door in a closed and locked position. The latch catch further functions to engage a switch to signal a locked condition of the door.

BRIEF DESCRIPTION OF THE DRAWINGS

The invention will be explained in greater detail by reference to the drawings accompanying this application in which:

FIG. 1 is a perspective view of a cooking appliance having an oven door latch in accordance with the present invention;

FIG. 2 is an enlarged partial cross-section view taken along line 2—2 in FIG. 1 with the door closed showing the latch and strike mechanism in a first position; and FIG. 3 is an enlarged partial cross-section view also taken along line 2—2 in FIG. 1 with the door closed and showing the latch and strike mechanism in a second position.

DESCRIPTION OF PREFERRED EMBODIMENTS

FIG. 1 depicts as domestic cooking appliance of the type generally referred to as a free standing kitchen range. The apparatus includes a range cabinet 10, a top portion which includes surface heating elements 11 and control panel 12, an oven cavity 13, and an oven door 14. It will be understood that although the specific components are not illustrated, the range is of the type adapted to provide both conventional thermal energy to cavity 13 as well as microwave energy, and is accordingly a combination range as that term is used herein.

The front panel 15 of range cabinet 10 contains apertures 16 on either side of oven cavity 13 and along the upper portion of the front panel. Rollers 17 and 18 can be seen in the apertures 16 as the rollers 17 and 18 are mounted inside the range cabinet in a manner described more fully hereinafter.

The construction of the door 14 and its latching mechanism is illustrated in greater detail in FIGS. 2 and 3. The door handle 20 extends across the width of the door 14 and is held in place by a pair of end caps 21, the end caps 21 are in turn secured to a rod 23 which extends across the width of the inside of door 14, the rod being clearly shown in cross-section in FIGS. 2 and 3.

The rod serves as the axis of rotation for handle 20 which can be rotated in an approximately vertical direction of movement. Also, secured to rod 23 toward each of its ends is a latch catch 22. The inside panel 19 of door 14 contains apertures 25 in its upper corners, and latch catches 22 extend through the apertures 25.

A pair of guide members 24 are mounted to the interior of door 14 in a fixed position. The guides are positioned outwardly of the latch catches 22 at each end of the rod 23. Each of the guide members 24 extend through an aperture 25 coextensively with the latch catches.

Since the handle 20 and latch catches 22 are fixed to rod 23 they share a common axis of rotation about the rod. Accordingly, rotation of the handle 20 causes a corresponding rotation of the latch catches 22. When the handle 20 is rotated downwardly the latch catches 22 rotate upwardly in a corresponding fashion.

The interior door latch components are also illustrated in FIGS. 2 and 3. The latch strike assemblies are located within the interior of the range cabinet 10 behind the front panel 15 in the upper front corners of the range. The various strike assembly components are mounted to a bracket 30 which is in turn mounted to the range cabinet 10. Each assembly includes a latch strike roller 17 and guide roller 18, switches 32 and 33, engaging arm 35, and guide arm and roller 34.

Certain conditions precedent to operation of a microwave oven must be met according to government standards, and it is also desirable to insure the existence of some of the same conditions during a pyrdytic self cleaning cycle where temperatures substantially in excess of those encountered in ordinary cooking are routinely present. Thus switch 33 may be employed to detect and signal a closed door configuration. It will be understood that switch 33 may be located on either the left or right side of the oven, or if desired may be duplicated and one such switch may be located on each side behind aperture 16. Similarly, switch 32 may be utilized to detect a door locked condition, and as previously described with reference to switch 33, switch 32 may be employed singly on either side or doubly, one switch on each side.

Door 14 is mounted to the range cabinet 10 in a conventional manner by means of hinges 40 on either side of the door 14 in the lower corners of the door and the range.

When the oven door 14 is rotated about hinges 40 to a closed position against the front panel 15, guide members 24 and the front portion of latch catch 22 pass through apertures 16 between latch strike roller 17 and guide roller 18. The bottom edge of the guide members 24 ride over guide rollers 18 which properly position the door. The leading edge of guide member 24 contacts engaging arm 35 and moves it rearwardly, closing switch 33 which may generate an electrical signal indicating that the door 14 is closed.

With the door in the closed position, the handle 20 and latch catches 22 will be positioned as shown in FIG. 2. The door handle 20 is in its upward position and the latch catches 22 lie along roller 18 in an approximately horizontal orientation. The front portion of the latch catches 22 includes a relatively flat surface portion **22*a* which transitions to a smoothly curved portion 22*b* curving to apex 22*c* and finally curving downwardly along surface 22*d***.

As handle 20 is rotated downwardly, latch catches 22 are rotated upwardly. As the latch catches move upward, the curved portion **22*b* engages latch strike roller 17 which, as have been pointed out, is fixed to range cabinet 10. The reaction of the rollers 17 on the cam surface of the latch catches 22 pulls the door 14 into snug engagement with the front panel 15. As handle 20 continues downward travel, cam surface 22*b* continues to travel along roller 17 to surface 22*a* where the catch 22 reaches the limit of its travel, at which point roller 17 bears on the relatively flat surface 22*a*. At this point, door 14 cannot be pulled open by outward force applied to handle 20**, and is in a locked condition.

As the latch catches 22 reach the full upward position, guide arm and roller 34 engages the lower edge of the latch catches to aid in holding them in an up and locked position. For this purpose, the guide arm and roller 34 may be spring loaded in the direction of the latch catches 22.

As the latch catches 22 rotate into the up and locked position, the apex **22*c* of the catches engages switch 32**. The switch is closed by such engagement providing a signal of the door locked condition.

The latch assembly described herein, in conjunction with the lower door hinges provides four point locking of the door, thus aiding in providing a tight fit between the door and the oven front panel which can be critical in meeting microwave emission standards. The close matching thus provided is also beneficial in retaining oven heat during thermal cooking, and during pyrolytic self cleaning cycles. The oven user is able to effect a positive door lock with a simple downward movement of the door handle itself, without the operation of additional levers or locking buttons. The latch mechanism not only provides the locking function, but also engages the interlock switches necessary to signal the appropriate closed and locked conditions.

While the invention has thus been described in considerable detail it will be understood that such detailed description is for illustrative purposes, and that many modifications to the structure can be made by those skilled in the art without departing from the spirit of the invention.

We claim:

1. A door latching and locking mechanism for a combination cooking appliance of the type adapted to cook foods with both thermal and microwave energy in a single oven cavity, said mechanism comprising an elongated rod member rotatably mounted in the oven door, said rod member oriented generally horizontally across the width of said door; handle means including end portions, said handle oriented generally horizontally across the width of said door and spaced away therefrom by said end portions, said end portions being fastened to the respective ends of said rod member; latch catch means mounted on said rod member and extending through the inside face of said door; latch engaging means mounted within the body of said appliance positioned adjacent said latch catch means when said door is in a closed position, wereby said latch catch means rotates into engagement with said latch engaging means to lock said door into a closed position as said handle means is rotated about the longitudinal axis of said rod member.

2. The apparatus of claim 1 including switch means for signalling a door locked condition when actuated and wherein said latch catch means actuates said switch means when said latch catch means is rotated into a locked position.

3. The apparatus of claim 1 wherein said latch catch means includes a camming surface including a curved portion and a generally flat portion; said latch engaging means being first contacted along said curved portion and finally along said generally flat portion as said latch catch means is rotated into a locked position.

4. The apparatus of claim 1 wherein said latch catch means comprises first and second latch catches each of said catches extending through an upper corner of said door.

5. The apparatus of claim 4 wherein said door is hinged to said appliance by a pair of hinges, each of said hinges being mounted in a lower corner of said door whereby said door is fastened to said appliance at each of its corners when in the closed and locked position.

6. The apparatus of claim 4 wherein downward rotation of said handle means causes the upward rotation of said latch catches and wherein said latch engaging means are mounted above said latch catches so as to engage said catches when said handle means is rotated in said downward direction.

7. A door latch and locking mechanism for a combination cooking appliance of the type adapted to cook foods with both thermal and microwave energy in a single oven cavity, said mechanism comprising an elongated rod member rotatably mounted in the oven door, said rod member oriented generally horizontally across the width of said door; handle means including end portions, said handle oriented generally horizontally across the width of said door and spaced away therefrom by said end portions, said end portions being fastened to the respective ends of said rod member; latch catch means mounted on said rod member and extending through the inside face of said door; latch engaging means mounted within the body of said appliance positioned adjacent said latch catch means when said door is in a closed position, whereby said latch catch means rotates into engagement with said latch engaging means to lock said door into a closed position as said handle means is rotated about the longutinal axis of said rod member; guide members mounted to said door adjacent said latch catch means and coextensive therewith; guide rollers mounted within the body of said appliance whereby said guide members ride on said rollers as said door is closed to correctly position said door.

* * * * *